US005839598A

United States Patent [19]

Mitchell

[11] Patent Number: 5,839,598

[45] **Date of Patent: *Nov. 24, 1998**

[54] COMBINATION LID AND SPILL TRAY

[75] Inventor: Donald J. Mitchell, Wellsburg, W. Va.

[73] Assignee: Eagle Manufacturing Company, Wellsburg, W. Va.

[ * ] Notice: The term of this patent shall not extend beyond the expiration date of Pat. No. 5,590,802.

[21] Appl. No.: 668,734

[22] Filed: Jun. 24, 1996

Related U.S. Application Data

[63] Continuation-in-part of Ser. No. 520,080, Aug. 28, 1995, Pat. No. 5,590,802.

[51] Int. Cl.[6] ..... B65D 1/36; B65D 45/34

[52] U.S. Cl. ..... 220/321; 220/212; 220/571.1; 220/626; 220/636; 220/729

[58] Field of Search ..... 220/321, 320, 220/571, 571.1, 212, 379, 608, 630, 636, 729, 744, 319, 378, 627, 626; 215/335

[56] References Cited

U.S. PATENT DOCUMENTS

| | | | |
|---|---|---|---|
| Re. 28,521 | 8/1975 | Hammes . | |
| 1,504,194 | 8/1924 | Treanor . | |
| 1,712,274 | 5/1929 | Knowles . | |
| 2,727,673 | 12/1955 | Bergstrom . | |
| 3,352,450 | 11/1967 | Rawlins | 220/571.1 |
| 3,606,074 | 9/1971 | Hayes | 220/212 |
| 3,696,962 | 10/1972 | Fehres et al. . | |
| 4,094,432 | 6/1978 | Zilbert . | |
| 4,177,934 | 12/1979 | Hammes et al. . | |
| 4,648,522 | 3/1987 | Wise . | |
| 4,708,258 | 11/1987 | Shaw et al. . | |
| 4,709,833 | 12/1987 | Granberg et al. . | |
| 5,096,083 | 3/1992 | Shaw et al. . | |
| 5,180,076 | 1/1993 | Hundt . | |
| 5,193,715 | 3/1993 | Schultz . | |
| 5,259,526 | 11/1993 | Stolzman . | |
| 5,358,133 | 10/1994 | Gillispie et al. . | |
| 5,373,958 | 12/1994 | Bokmiller . | |
| 5,427,264 | 6/1995 | Addison . | |
| 5,590,802 | 1/1997 | Mitchell | 220/321 |
| 5,598,941 | 2/1997 | Semersky et al. | 220/608 X |

FOREIGN PATENT DOCUMENTS

| | | |
|---|---|---|
| 0364361 | 8/1908 | France . |
| 092012062 | 7/1992 | WIPO . |

*Primary Examiner*—Stephen J. Castellano
*Assistant Examiner*—Niki M. Kopsidas
*Attorney, Agent, or Firm*—Armstrong, Westerman, Hattori, McLeland & Naughton

[57] ABSTRACT

A blow molded combination lid and spill tray has a top wall and a downwardly depending skirt thereabout, the top wall formed from a pair of upper and lower circular walls. The upper and lower circular walls have a central feed circular recess, plurality of circumferentially spaced fused arcuate channels and plurality of second spaced fused arcuate channels with first and second circular hollow sections and first and second radial hollow sections, the hollow sections communicating with a hollow of the downwardly depending skirt. The lid when placed on a supporting surface with the skirt extending upwardly will contain a drum and accumulate spillage or drippage from the drum in the recesses.

12 Claims, 4 Drawing Sheets

COMBINATION LID AND SPILL TRAY

CROSS-REFERENCE TO RELATED APPLICATION

This application is a continuation-in-part of application Ser. No. 08/520,080 filed Aug. 28, 1995 in the name of Donald J. Mitchell and entitled "Salvage Drum With Protected Clamping", said application assigned to the assignee of the present application, and incorporated by reference herein.

FIELD OF THE INVENTION

The present invention relates to a circular lid for use in sealing a container and which circular lid may also be used as a spill tray for industrial drums.

BACKGROUND OF THE INVENTION

Salvage drums are used to ship and store drums containing contaminated solids and also industrial drums containing oils, solvents, and the like and are generally of a size such that the contents of the industrial drum will be retained in the salvage drum upon spillage or leakage. Various sealed salvage drums, and containers, which may be made of polyethylene, are shown, for example, in U.S. Pat. No. 4,708,258; U.S. Pat. No. 4,709,833; U.S. Pat. No. 5,096,083; U.S. Pat. No. 5,180,076; U.S. Pat. No. 5,358,133 which is assigned to the assignee of the present invention, and U.S. Pat. No. 5,373,958. Such salvage drums comprise a container or body portion and a lid which is sealed to the container either by use of a threaded connector between the container and the lid or by use of a ring clamp, usually made of steel, which encloses a container lip and a lid lip and secures the two lips together in a sealing relationship. U.S. Pat. No. 5,373,958, for example shows a blow molded container and lid where the two are secured together by mating threaded portions.

In co-pending application Ser. No. 08/520,080, a salvage drum is described which has a container body and a circular lid which are secured together with a clamp that is protected from impact by the presence of a combination of outwardly extending vertical ribs adjacent a body lip and an outwardly extending protective shoulder on the circular lid. As described in said co-pending application, the lid is blow molded, preferably from polyethylene, to the desired shape.

It is an object of the present invention to provide a blow molded container lid which has a top wall that is formed from a pair of upper and lower circular walls that are fused together at predetermined locations but also provide hollow portions where the upper and lower circular walls are spaced apart.

It is another object of the present invention to provide a blow molded lid with an outwardly extending shoulder and recessed lip for use in sealing a container body.

It is a further object of the present invention to provide a blow molded lid which can also serve as a drip or spill tray when used with an industrial drum.

SUMMARY OF THE INVENTION

A combination blow molded lid and spill tray, formed from a thermoplastic material such as polyethylene, is a lid having a top wall with a downwardly depending hollow skirt about the top wall, the top wall being formed from a pair of upper and lower circular walls. The pair of upper and lower circular walls are fused together at predetermined locations so as to form in the lower wall a central fused circular recess, a plurality of circumferentially spaced first arcuate channels, spaced from the recess, and a plurality of circumferentially spaced second fused arcuate channels that are spaced from and circumferentially offset from the first arcuate channels. The pair of upper and lower walls also form a first circular hollow section between the recess and the plurality of first arcuate channels, first radial hollow sections between the first arcuate channels, a second circular hollow section between the plurality of first arcuate channels and the plurality of second arcuate channels, and second radial hollow sections between the plurality of second arcuate channels which communicate with the hollow of the downwardly depending skirt of the lid. Communication is effected between the first circular hollow section, first radial sections, second circular hollow section and second radial hollow sections and the hollow of the downwardly depending skirt of the lid.

The hollow downwardly depending skirt of the lid preferably has an outwardly extending lip that is a portion of the lower inner and outer walls of the hollow downwardly depending skirt, with the lip preferably formed by fusing of the outer and inner walls together and also preferably with a gasket receiving groove formed in the lower surface of the lip.

The lid is usable to seal a container body by placement of the lid on the body and sealing the two together. The lid can also serve as a spill tray by placement of the lid on a surface with the skirt extending upwardly, such that a drum or other container can be supported by the hollow sections of the lid, with spillage collected in the fused channels of the lid.

BRIEF DESCRIPTION OF THE DRAWINGS

The present invention will be more readily understood by reference to the drawings which illustrate a preferred embodiment of the present invention wherein.

DETAILED DESCRIPTION

Figure 1:
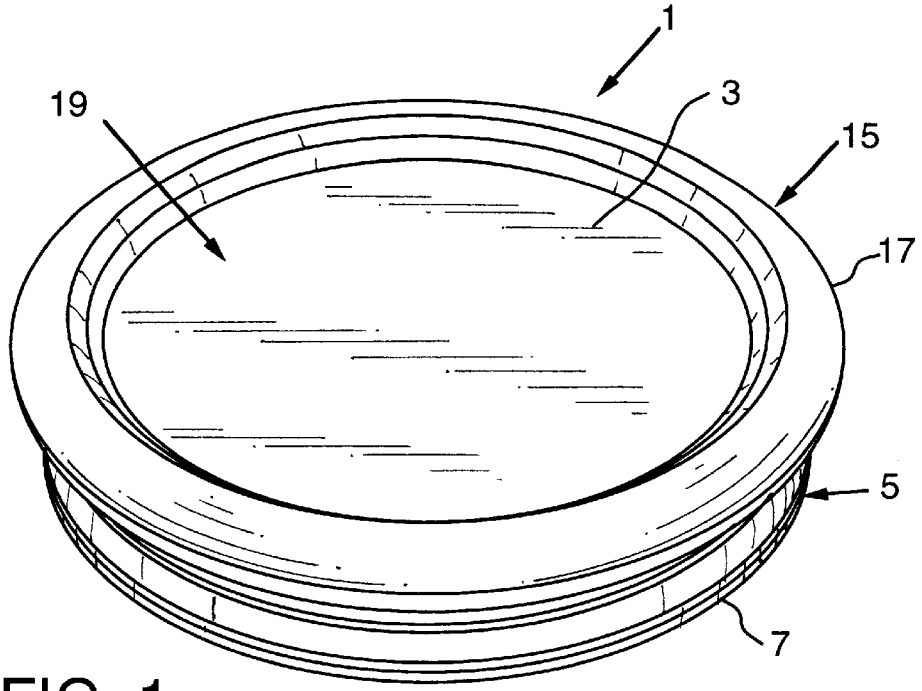
FIG. 1 is a top isometric view of the lid of the present invention.
Figure 2:
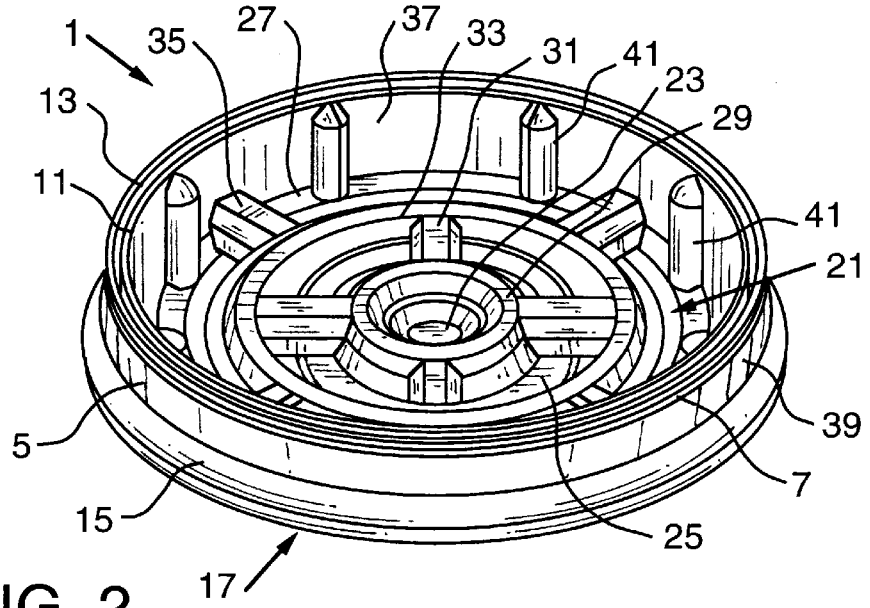
FIG. 2 is a bottom isometric view of the lid of the lid of the present invention.
Figure 3:
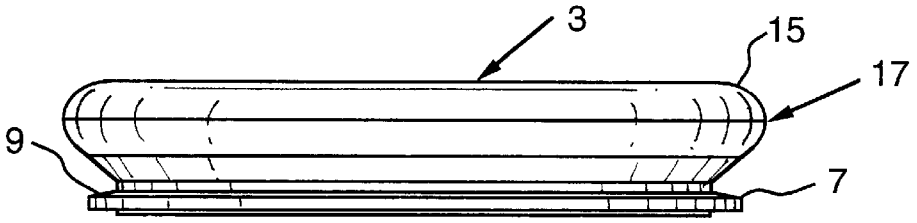
FIG. 3 is a side elevational view of the lid shown in FIG. 1.
Figure 4:
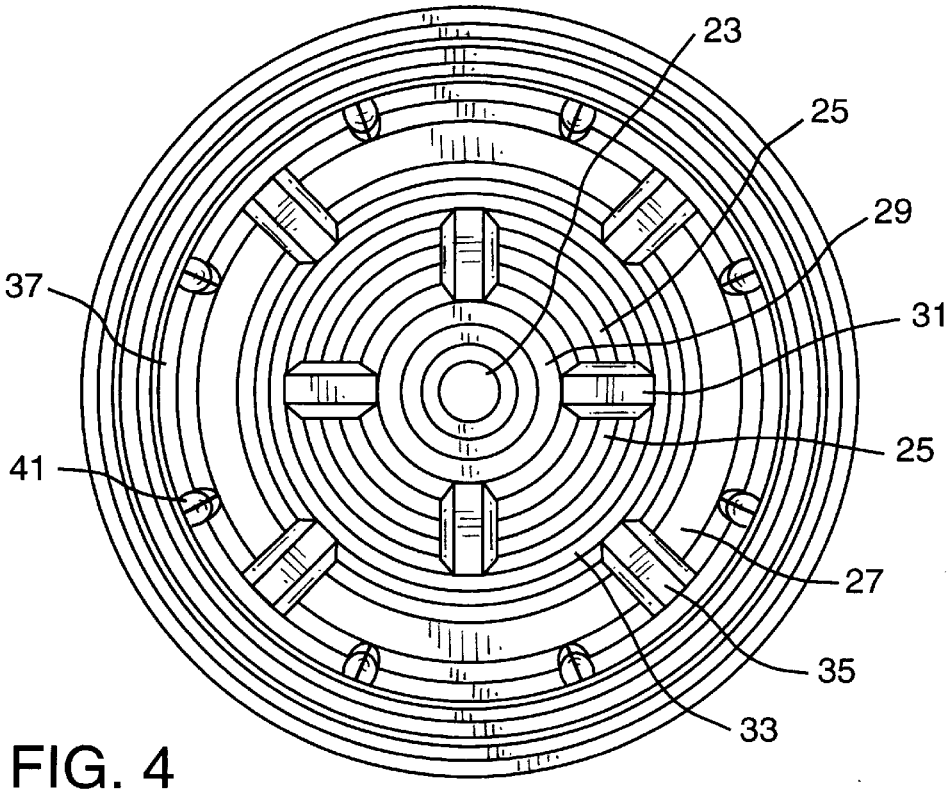
FIG. 4 is a bottom plan view of the lid shown in FIG. 1.

Referring now to the drawings, the combination circular lid and spill collector 1 of the present invention has a top wall 3 and a downwardly depending hollow skirt 5 about the periphery thereof, the skirt preferably having an outwardly extending lip 7. The lip 7 of the lid preferably has a downwardly sloped upper surface 9 which, with the lower edge 11 of the downwardly depending skirt 5 forms a gasket receiving groove 13 in the lip 7. Preferably, there is also an outwardly extending protective shoulder 15 on the lid, which is also hollow, and which preferably has a radially outermost arcuate surface 17.

The circular lid 1 is blow molded of a thermoplastic resin, such as a polyethylene homopolymer or copolymer or other thermoplastic material, and is provided with fused and hollow sections in the top wall of the lid.

Figure 5:
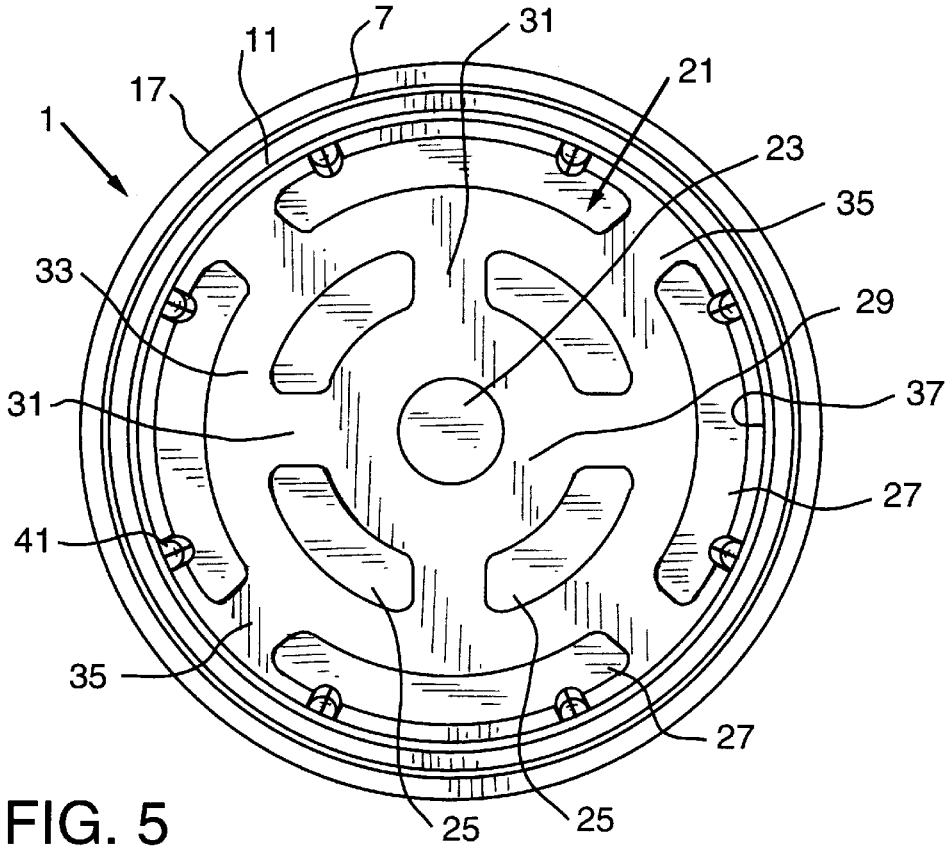
FIG. 5 is a bottom plan view similar to FIG. 4 with the bevelled portions or radii of corners removed to more clearly show the arrangement of the fused channels and hollow sections of the lower wall of the lid.
Figure 6:
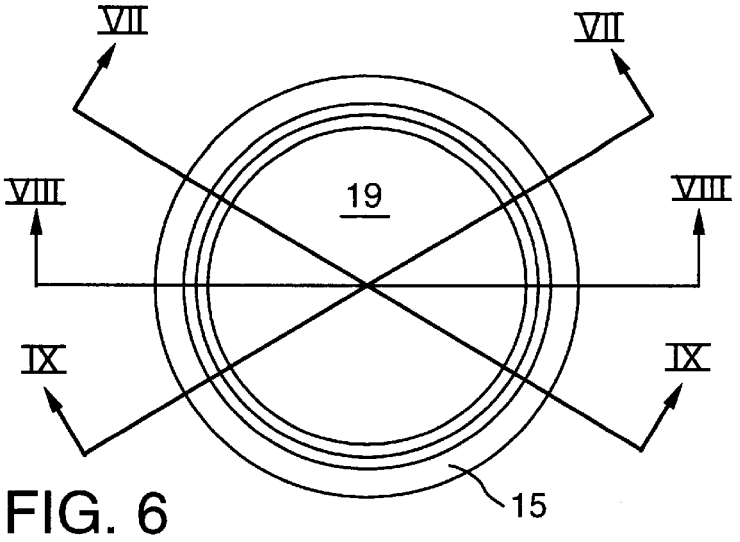
FIG. 6 is a top plan view of lid shown in FIG. 1.
Figure 7:
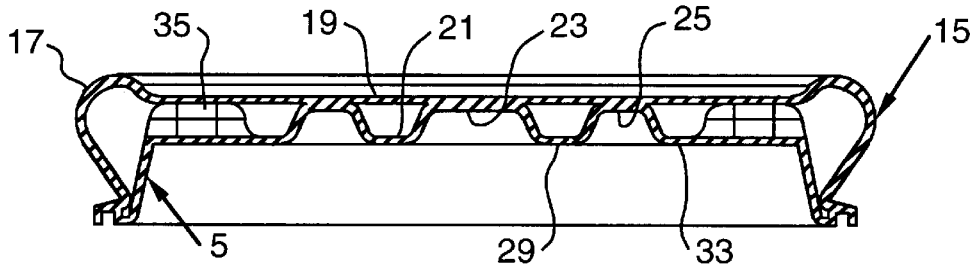
FIG. 7 is a cross-sectional view of the lid taken along lines VII—VII of FIG. 6.
Figure 8:
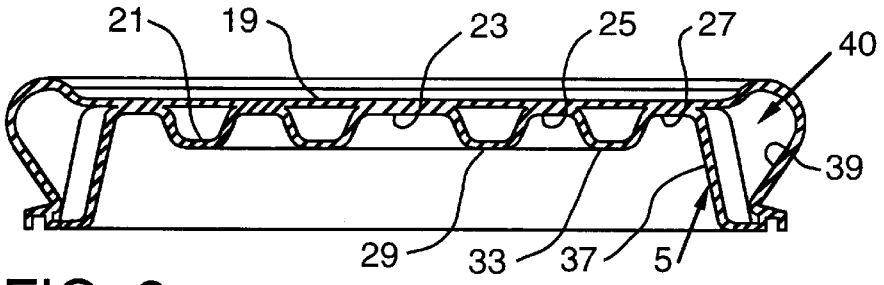
FIG. 8 is a cross-sectional view of the lid taken along lines VIII—VIII of FIG. 6.
Figure 9:
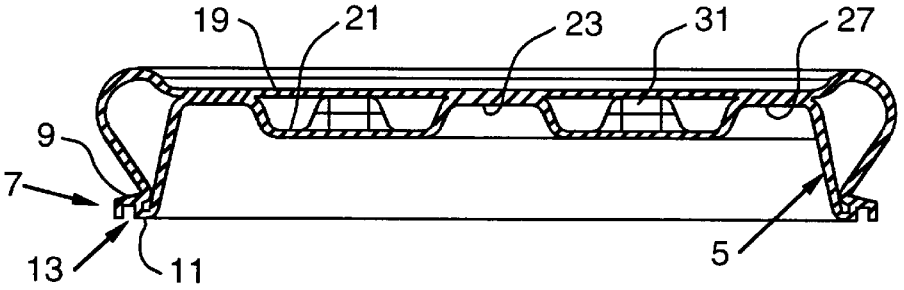
FIG. 9 is a cross-sectional view of the lid taken along lines IX—IX of FIG. 6.

The top wall 3 is formed, by blow molding from a pair of upper and lower circular walls 19 and 21, respectively, which are fused together at predetermined locations so as to form a central recess and arcuate channels in the lower wall 21. As best illustrated in FIG. 5, fusing of the upper wall 19 and lower wall 21 forms a central fused circular recess 23, a plurality of circumferentially spaced first fused arcuate channels 25 spaced from the central fused circular recess 23, and a plurality of circumferentially spaced second fused arcuate channels 27 spaced from the first arcuate channels 25, with the second arcuate channels 27 being circumferentially offset from the first arcuate channels 25.

With formation of only the recess 23 and channels 25 and 27 by fusing of the upper circular wall 19 and lower circular wall 21, hollow sections will remain in the lid 1. As illustrated, the pair of upper and lower walls 19 and 21 will form a first circular hollow section 29 between the central fused circular recess 23 and the plurality of first fused arcuate channels 25, and first radial hollow sections 31 between the spaced plurality of first fused arcuate channels 25. A second circular hollow section 33 is formed between the plurality of first fused arcuate channels 25 and the plurality of spaced second fused arcuate channels 27, and second radial hollow sections 35 are formed between the spaced plurality of second fused arcuate channels 27.

The downwardly depending hollow skirt 5, as illustrated has an inner wall 37 and a spaced outer wall 39 which form a hollow 40 therebetween. The inner and outer walls are fused together to form the outwardly extending lip 7, with a gasket receiving groove 13 formed in the lower surface of the lip. If desired, vertical ribs 41 may be provided on the inner wall 37 of the downwardly depending hollow skirt 5 for purposes of additional strength. Also, as illustrated, the inner wall 37 is generally normal to the top wall such that when the lid 1 is secured on a container body, the inner wall 37 will be superimposed over the vertical side wall of a container and distributes vertical forces to the container body.

With blow molding of the present combination lid and spill tray 1, there will be communication between all of the hollow sections thereof, with the circular first hollow section 29 communicating with the first radial hollow sections 31, the first radial hollow sections 31 then communicating with second circular hollow sections 33, and the second circular hollow sections 33 then communicating with the second radial hollow sections 35, and the second radial hollow sections 35 then communicating with the hollow of the downwardly depending skirt 5. Such an arrangement provides strength to the lid and distribution of forces acting on the lid throughout the lid 1.

As described in co-pending application Ser. No. 08/520,080 the circular lid can be used to seal a container body and form a sealed salvage drum by placing the lid on the container with the lid lip contiguous with a body lip and securing the two elements together by use of a ring clamp. A gasket may be seated in the gasket receiving groove 13 in the lid lip 9 and frictionally secured thereon or adhesively secured to provide an even more secure seal between the lid and a container body.

Figure 10:
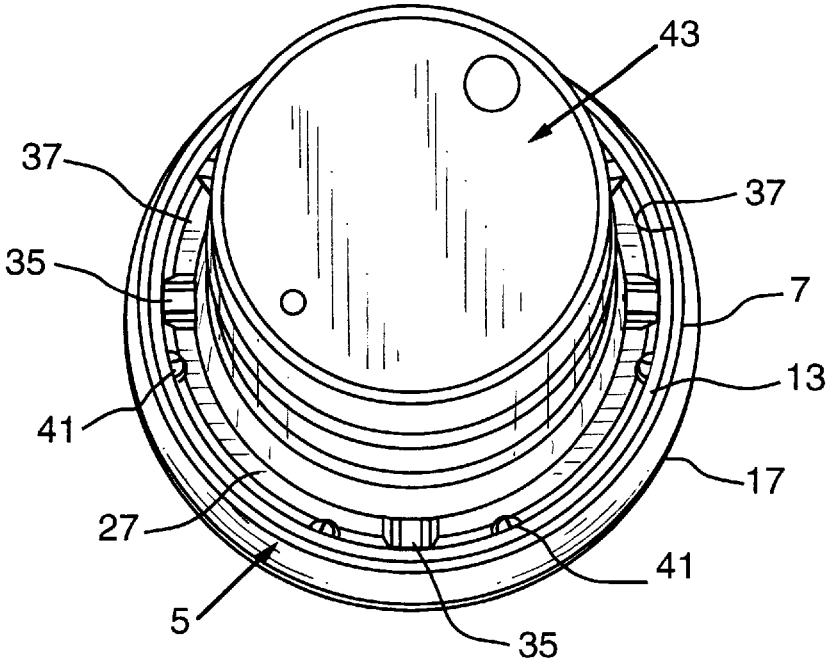
FIG. 10 is an isometric view showing the lid used as a spill tray and with a drum resting within the hollow skirt on the hollow sections of the top wall.
Figure 11:
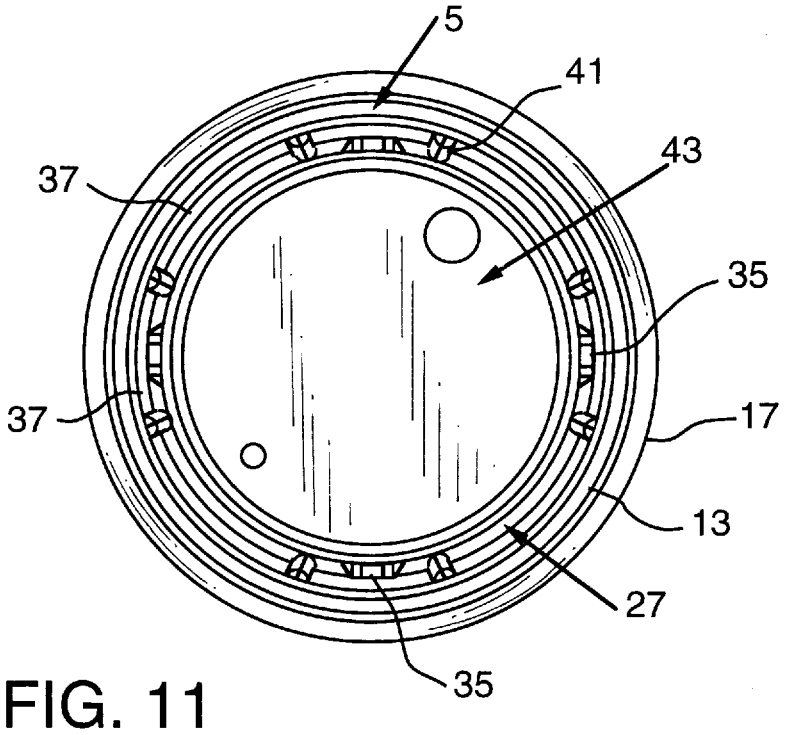
FIG. 11 is a top plan view of the lid and drum illustrated in FIG. 10.

An advantage of the present lid is that it can also serve as a spill or drip tray when used with a conventional solvent or oil drum, as illustrated in FIGS. 10 and 11. For such use, the lid 1 is placed on a supporting surface with the hollow skirt 5 facing upwardly away from the supporting surface, and a drum seated within confines of the inner wall 37. When a large size drum 43, having a diameter slightly less than the diameter of the inner wall 37 of the lid 1 as seated within the confines of the hollow skirt, the drum will rest on the second radial hollow sections 35 and will be elevated from the second fused arcuate channels 27. Any drippage or spillage from discharge of the drum contents will collect in the second fused arcuate channels 27 and, if those channels become full will flow to the first fused arcuate channels 25 and finally to the central fused circular recess 23. If a smaller diameter drum is to be seated in the confines of the hollow skirt 5, the smaller drum would rest on either the second circular hollow section 33, the first radial hollow sections 31, or the first circular hollow section 29, so as to assure that support for the drum will be provided by hollow sections in the top wall of the lid and that channels will be provided below the drum for collection of drippage or spillage therefrom. Any spillage or drippage from a large drum will first collect in the plurality of spaced second fused arcuate channels 27 and will be visible to the user, while additional spillage or drippage will flow to the first fused arcuate channels 25 and finally to the central fused circular recess 23, well before any spillage will accumulate to an extent that the same might overflow the confines of the hollow skirt 5, thus allowing sufficient time for determining, and correcting any problems associated with such spillage or drippage. The presence of vertical ribs 41 on the inner wall 37 of the skirt 5 also assures that any drum seated in the confines of the skirt will be spaced from the inner wall 37 to provide flow of spillage or drippage to the second fused arcuate channels 27 without flowing outside the confines of the skirt 5 and down the outside of the skirt 5.

What is claimed is:

1. A combination lid and spill tray comprising:

a circular lid, formed by blow molding of a thermoplastic resin, having a top wall with a downwardly depending skirt about the periphery thereof, said downwardly depending skirt having a hollow;

said top wall formed from a pair of upper and lower circular walls, said pair of upper and lower walls being fused together at predetermined locations so as to form in said lower wall a central fused circular recess, a plurality of circumferentially spaced first fused arcuate channels, spaced from said recess, and a plurality of circumferentially spaced second fused arcuate channels circumferentially offset from and spaced from said first channels;

said pair of upper and lower walls forming a first circular hollow section between said recess and said plurality of first fused arcuate channels, first radial hollow sections between said plurality of first fused arcuate channels, a second circular hollow section between said plurality of first fused arcuate channels and said plurality of second fused arcuate channels, and second radial hollow sections between said plurality of second fused arcuate channels communicating with the hollow of said downwardly depending hollow skirt.

2. The combination lid and spill tray as defined in claim 1 wherein said downwardly depending skirt has an inner wall and an outer wall with said inner and outer walls fused together so as to form an outwardly extending lip.

3. The combination lid and spill tray as defined in claim 2 wherein said outwardly extending lip has a gasket receiving groove formed therein.

4. The combination lid and spill tray as defined in claim 1 wherein said downwardly depending skirt has an inner wall generally normal to said top wall.

5. The combination lid and spill tray as defined in claim 4 wherein said downwardly depending skirt has an outer wall with an outwardly extending protective shoulder thereon.

6. The combination lid and spill tray as defined in claim 4 wherein vertical ribs are provided on the inner wall of said downwardly depending skirt.

7. The combination lid and spill tray as defined in claim 1 wherein communication is present between said first circular hollow section, said first radial hollow sections, said second circular hollow section, said second radial hollow sections and the hollow of said downwardly depending skirt.

8. A combination lid and spill tray comprising:

a circular lid, formed by blow molding of a thermoplastic resin, having a top wall with a downwardly depending skirt about the periphery thereof, said downwardly depending skirt having a hollow;

said top wall formed from a pair of upper and lower circular walls, said pair of upper and lower walls being fused together at predetermined locations so as to form in said lower wall a central fused circular recess, a plurality of circumferentially spaced first fused arcuate channels, spaced from said recess, and a plurality of circumferentially spaced second fused arcuate channels circumferentially offset from and spaced from said first channels;

said pair of upper and lower walls forming a first circular hollow section between said recess and said plurality of first fused arcuate channels, first radial hollow sections between said plurality of first fused arcuate channels communicating with said circular hollow section, a second circular hollow section between said plurality of first fused arcuate channels and said plurality of second fused arcuate channels communicating with said first radial hollow sections, and second radial hollow sections between said plurality of second fused arcuate channels communicating with said second circular hollow section and the hollow of said downwardly depending skirt.

9. The combination lid and spill tray as defined in claim 8 wherein said downwardly depending skirt has an inner wall generally normal to said top wall.

10. The combination lid and spill tray as defined in claim 9 wherein said downwardly depending skirt has an outer wall with an outwardly extending protective shoulder thereon.

11. The combination lid and spill tray as defined in claim 9 wherein vertical ribs are provided on the inner wall of said downwardly depending skirt.

12. The combination lid and spill tray as defined in claim 8 wherein said downwardly depending skirt has an inner wall and an outer wall, with said inner and outer walls fused together so as to form an outwardly extending lip.

* * * * *